US005816958A

United States Patent [19]

Seymour

[11] Patent Number: 5,816,958

[45] Date of Patent: Oct. 6, 1998

[54] TENNIS RACKET

[76] Inventor: Geoffrey S. Seymour, 838 Knapp Dr., Montecito, Calif. 93108

[21] Appl. No.: 694,388

[22] Filed: Sep. 16, 1996

[51] Int. Cl.[6] ..... A63B 49/08

[52] U.S. Cl. ..... 473/526

[58] Field of Search ..... 473/516, 524, 473/526

[56] References Cited

U.S. PATENT DOCUMENTS 2,147,110 2/1939 Schmid ..... 473/526
4,155,550 5/1979 Planakis ..... 473/526
4,183,528 1/1980 An ..... 473/526
4,221,383 9/1980 Cappelli ..... 473/526

*Primary Examiner*—William E. Stoll
*Attorney, Agent, or Firm*—Christie, Parker & Hale, LLP

[57] ABSTRACT

A tennis racket has a head, a neck, a handle shaft, and a handle. The head and neck lie substantially in a face plane. The handle is offset in parallel from the face plane by a handle shaft. The handle shaft has a quarter circle arch which merges with the handle at one end and with another arch at the other end. The other arch merges with the neck of the racket. The arches have opposite concavity thus offsetting the handle from the face plane.

11 Claims, 2 Drawing Sheets

16
12
18
14
22
20
32
34
2
4
6
8

TENNIS RACKET

BACKGROUND OF THE INVENTION

The invention pertains to a sports racket. More particularly it pertains to a configuration of a handle shaft for a tennis racket.

A wide variety of tennis racket designs are currently on the market. Rackets are generally constructed of wood, metal or composite materials. The standard design of the traditional all-wood racket comprises a substantially oval head with a unitary neck and handle shaft descending from a base of the head. A handle having an elongated octagonal cross-section, and being wrapped with leather tape to form a grip is formed at the end of the shaft. The racket head bears a plurality of holes through which a string is laced under tension to create a racket face with which a ball may be struck. The standard all-wood racket has a face of approximately 75 square inches in area. Specimens of such rackets include the JACK KRAMER by WILSON, the MAXPLY FORT by DUNLOP and the IMPERIAL DELUXE by DAVIS.

The all-wood racket has been all but completely replaced by metal and then composite framed rackets. In most metal rackets, the head, neck and shaft are formed from a single piece of tubing so that the shaft consists of parallel end sections of the tubing. The base of the head will generally be supplied by attaching a short metal or plastic member between the two sections of the tube.

A typical modern racket will be constructed of a composite material including carbon or KEVLAR fiber. The material is formed into a frame which comprises a large substantially oval head and an approximately triangular neck formed by the base of the head and two shafts which extend downward and inward from the base of the head, merging to form a single handle shaft. A handle having an elongated octagonal cross-section and being wrapped with leather tape is formed at the end of the shaft. The periphery of the head bears a plurality of holes through which a string is laced under tension to create a racket face with which a ball may be struck.

Use of composite materials has allowed an expansion of the head to a point where most modern rackets feature a racket face of between 90 and 110 square inches in area. There has been a corresponding increase in the size of the "sweet spot" of the racket, that is the area within the racket face with which a ball may be struck while still producing an acceptably true shot. When advantage is taken of the larger sweet spot, and a ball is struck farther away from the racket center line, or handle axis, there will be increased torque, along the handle axis, transmitted to the user's hand due to the moment arm created by the off-center shot. Such shots may increase arm strain such as is associated with "tennis elbow."

In addition to the increases in head size, a variety of modifications regarding the shape of the head have taken place within the scope of a substantially oval head. Some racket heads may be closer to a perfect ellipse than others, some may incorporate slight polygonal features and others have varied aspect ratios (width relative to length of the head).

Although the vast majority of rackets in use fall into the above types, various modifications have been tried. U.S. Pat. No. 4,221,383 to Cappelli discloses a racket in which the handle is offset from the plane of the racket face. Otherwise of conventional metal tube design, the neck and parallel-tube shaft are angled relative to the plane of the racket face.

The offset of the Cappelli racket alters the form and timing of a player's shot. Timing is altered in that when used in the preferred way, on a forehand shot the racket face is ahead of the handle and thus contact is made at an earlier time than with a conventional racket. Conversely, on the backhand shot, there will be a delay as the racket face trails the handle. Also on the forehand shot the moment due to the weight and offset of the racket head will tend to aim the leading side of the racket face slightly downward altering the angle of contact with the path of a ball. Again, on the backhand shot, the leading side of the face will be inclined slightly upward, altering the angle of contact with the path of the ball.

U.S. Pat. No. 4,861,030 to Burt discloses a racket with two handles. The two tubes of a metal framed racket which descend from the neck and would otherwise form the handle shaft instead curve apart and a separate handle is attached to the end of each. The racket is designed to allow ambidextrous players to play a forehand to either side. The holder of that Patent produces another, unpatented, dual handle racket in which the handle grips are in a plane perpendicular to the racket. The racket is made of composite material and the grips form a wishbone structure with the shaft extending from the racket neck.

SUMMARY OF THE INVENTION

The present invention provides a racket which is of conventional design from the neck up, but below the neck, adjacent to the handle, the handle shaft has an offset section which extends out of the plane defined by the racket face. The offset section has an arch that lifts the shaft out of the racket face plane and a second quarter circle arch which merges with the handle. Having the offset section near the grip allows for increased flexibility and a concomitant reduction in stress on the user (lowering the risk of "tennis elbow") without otherwise losing the benefits of a relatively stiff racket. Additionally with this racket design, a great variety of shots may be obtained by varying the placement of the player's hand on the grip.

DESCRIPTION OF THE DRAWINGS

The above-mentioned and other features of this invention are more fully set forth in the following detailed description of the presently preferred embodiment of this invention; such description is presented with reference to the accompanying drawings wherein.

DESCRIPTION OF THE ILLUSTRATED EMBODIMENT

Figure 1:
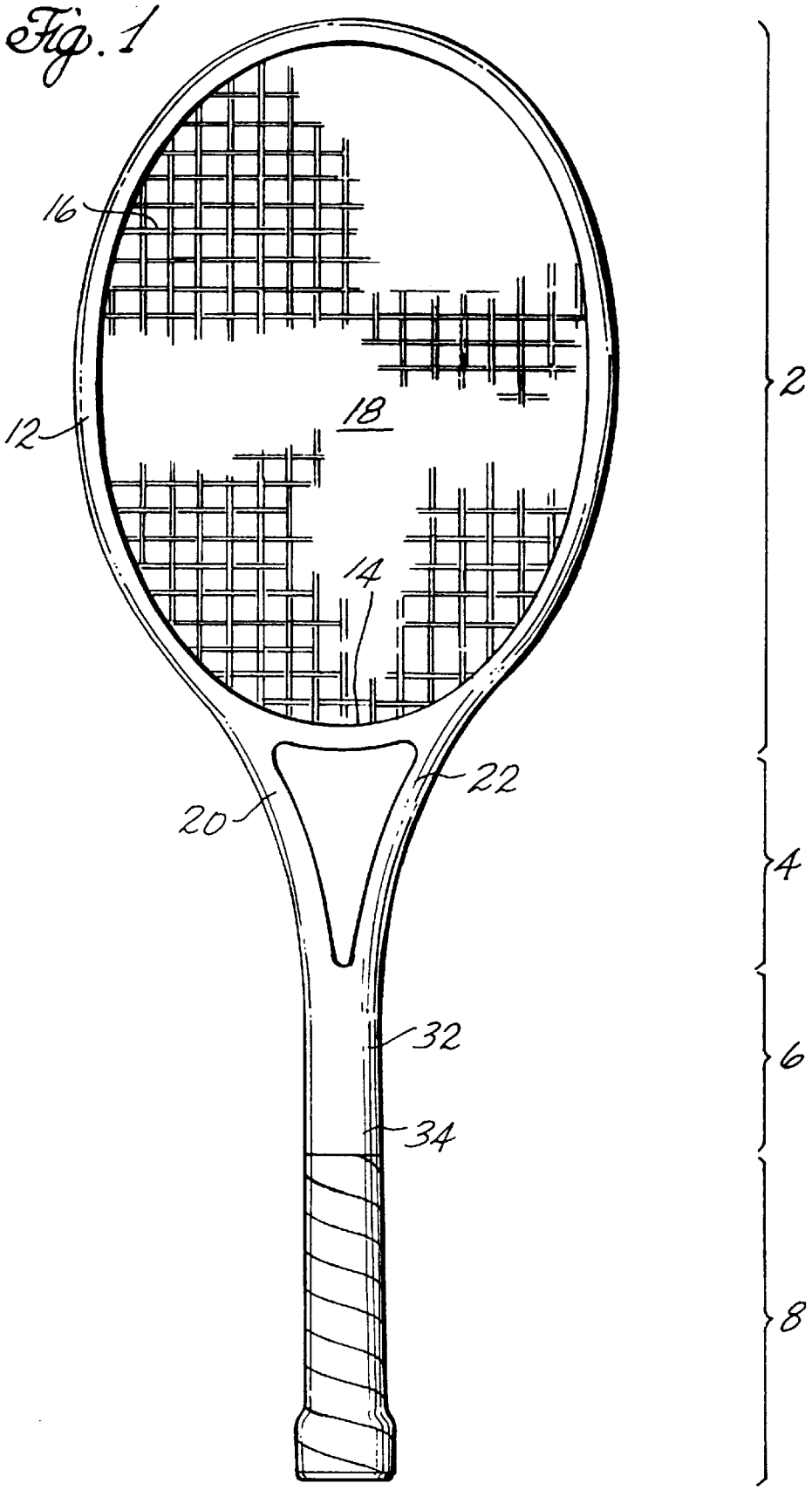
FIG. 1 is a front elevational view of a tennis racket according to principles of the present invention.
Figure 2:
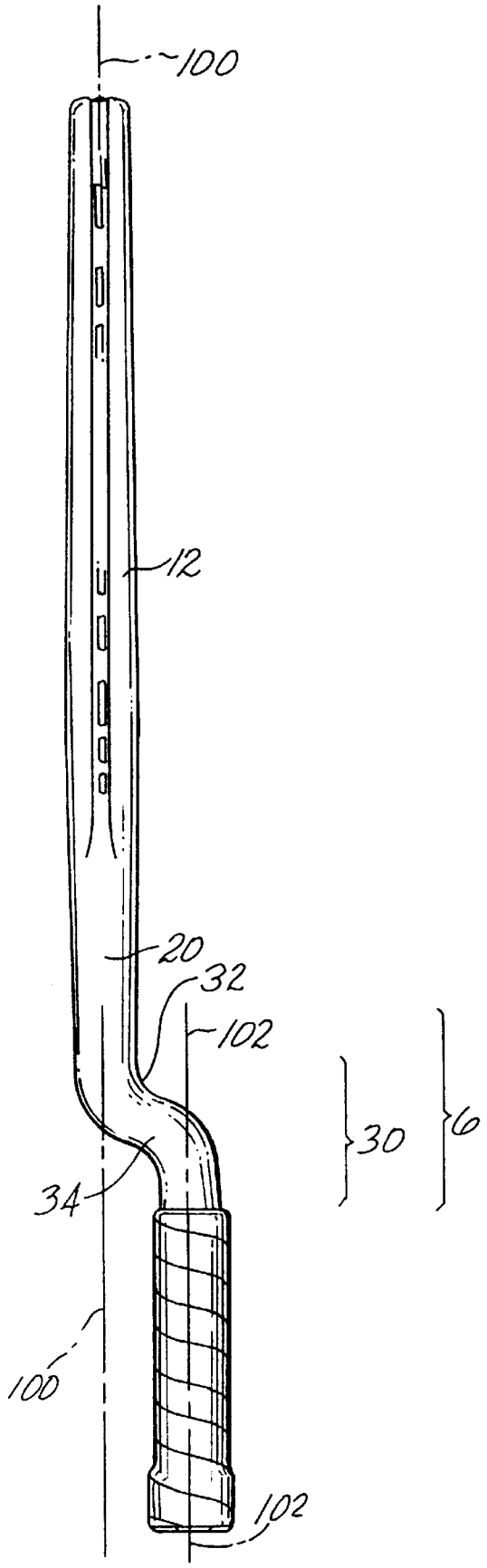
FIG. 2 is a side elevational view of the racket of FIG. 1.

A tennis racket according to the preferred embodiment of the present invention is depicted in FIGS. 1 and 2. The racket comprises a head 2, a neck 4, a handle shaft 6 and a handle 8. The head has a substantially oval shape defined by a curved rim tube 12 and a base tube 14. Stringing 16 is interlaced in a grid across the head 2 to form an approximately planar racket face 18. The neck 4 is formed by two shaft members 20 and 22 which are extensions of the rim tube 12 and which, along with the base tube 14, form an approximate triangle. The two shaft members 20 and 22 join to form the handle shaft 6. At the intersection of the shaft members, the handle shaft 6 is approximately coplanar with the racket head 2 and neck 4. As shown, shaft 6 has an offset section 30 with a first arch 32 that lifts the shaft out of the racket face plane 100 and a second quarter circle arch 34 (i.e., an arch that has a quarter circle geometry), which merges with the handle 8 such that the central longitudinal handle axis 102 (hereinafter handle axis) is sharply offset in parallel from the racket face plane. In an alternate embodiment, only the first arch is a quarter circle arch. In yet a further alternate embodiment, both arches are quarter circle arches.

The offset section 30 is relatively short, i.e., it spans only a portion of the shaft length, thereby providing for the sharp parallel offset of the handle from the face plane. As shown the arch 32 has concavity in a direction facing away from the racket face plane and the quarter circle arch 34 has concavity in a direction facing toward the racket face plane. In the preferred embodiment, depicted in FIGS. 1 and 2, the offset section is proximate to the handle.

The racket is preferably constructed of carbon and KEVLAR fiber tubing. The racket may be initially manufactured in the illustrated form or may be achieved as a modification of a conventional racket. In the latter case the racket may be formed by cutting the racket's handle shaft and then grafting a member, which comprises the offset section and the handle, onto the remaining upper part of the handle shaft. The offset section 30 may be formed with a foamed plastic core.

In the racket of the preferred embodiment the head is substantially oval, having a width of 9.5–10.5 inches and a length of 13.5–14.5 inches. The head defines a striking face of area 90–110 square inches. The two shafts which form the neck are separated by a distance of 3.5–4.5 inches at the points of attachment to the base of the head and merge at a point 4–6 inches below the head. The curved section begins 0.75–2 inches below the merger of the shafts and is configured to separate the handle axis 1.5–2 inches from the racket face plane.

The racket of the preferred embodiment may be played with the head leading the handle on the forehand in the manner disclosed by Cappelli. It has, however, also been found to offer excellent performance when reversed. Thus a player can choose to use the racket in either orientation based upon his or her individual preferences. The player can switch orientations thus permitting more varied selection of shots and potentially confusing an opponent.

Unlike Cappelli, the racket of the preferred embodiment has been observed as providing a degree of shock absorption and a concomitant reduction of hand and forearm strain of the type associated with "tennis elbow." This is believed to be due to the use of a quarter circle arch 34 to offset the handle from the racket plane face. The quarter circle geometry provides for optimum strength and flexibility. The flexibility inherent in the quarter circle arch geometry allows for shock absorbance. To vary the flexibility, the racket may be fabricated with both arches having a quarter circle geometry or the radius of each arch may be varied.

This shock absorbance has not been accompanied by deleterious effects on performance usually observed in an overly flexible specimen of a conventional design racket. In other words, many conventional design rackets that are flexible enough to provide the same degree of protection against physical strain as the present racket suffer from an undue loss of control. This phenomenon may be in part due to the principle that if bending is significantly isolated to the offset section of the present racket, which is far from the head, a given linear deflection of the head along the impact trajectory of a ball will produce a lower angular deflection of the head than in a conventional racket which does not have isolated flexing.

In addition to the aforementioned reduction in shock, the racket has been observed to provide shock absorption for the torque associated with hitting the ball off-center from the center line on the racket face. The increased shock absorption allows a player to swing harder without encountering excessive shock, thus increasing the power the player is willing to apply to the ball, regardless of whether the racket head is in front of or behind the handle.

The foregoing description of this invention is not an exhaustive catalog of all the ways in which the invention may be structured and proportioned. Rather, the description is illustrative and exemplary. Those skilled in the art to which the invention pertains will recognize and readily appreciate that other arrangements are possible within the fair scope of the invention and by which the performance made possible by the invention can be achieved. Therefore, the following claims are to be read, where proper, as having application to both those things described above and shown in the drawings, and those other things which, while not expressly described, are within the fair scope of the invention according to the principles of equivalence.

What is claimed is:

1. A racket comprising:

a head;

a string grid disposed across the head to define a face lying substantially in a face plane;

a neck rigidly connected to said head, lying substantially in said face plane, and comprising, a neck shaft attached to a base of said head, a single handle having a central longitudinal handle axis, and a handle shaft offsetting the handle in parallel from the neck shaft, the handle shaft having a first arch merging with a second quarter circle arch which merges with the neck shaft, wherein the two arches have opposite concavity.

2. A racket as recited in claim 1 wherein the quarter circle arch has a concavity toward the racket face plane.

3. A racket as recited in claim 1 wherein the first arch is a quarter circle arch.

4. A racket as recited in claim 1 wherein the second quarter circle has a radius ranging from ¾ to 1 inch.

5. A tennis racket comprising:

a head having a rim and a base;

a string grid disposed across the head to define a face lying substantially in a face plane;

a neck rigidly connected to said head and lying substantially in said face plane and comprising two neck shafts connected to the base of the head;

a single handle, having a central longitudinal handle axis parallel to and offset from the racket face plane; and a handle shaft connecting the handle to the neck, said handle shaft having a first arch merging into a second quarter circle arch, wherein the two arches have opposite concavity thereby offsetting the handle from the face plane.

6. A racket as recited in claim 5 wherein the second quarter circle arch has a concavity toward the face plane.

7. A racket comprising:

a head defining a face plane;

a single handle offset in parallel from the face plane by a handle shaft, wherein the handle shaft comprises a first arch and a second quarter circle arch, the second arch having opposite concavity from the first arch.

8. A racket as recited in claim 7 wherein the quarter circle arch has a concavity toward the racket face plane.

9. A racket as recited in claim 7 wherein the first arch is a quarter circle arch.

10. A racket as recited in claim 7 wherein the second quarter circle has a radius ranging from ¾ to 1 inch.

11. The racket of claim 7 wherein the handle shaft has a foamed plastic core.

* * * * *